US006276106B1

(12) United States Patent
Shotton et al.

(10) Patent No.: US 6,276,106 B1
(45) Date of Patent: Aug. 21, 2001

(54) HYDROPHILIC WATERBAR FOR DIAPHRAGM WALL JOINTS

(75) Inventors: Peter Gilbert Shotton, Bucks; Francis John Micallef, Dagenham, both of (GB)

(73) Assignee: Kvaerner Cementation Fondations Limited, Rickmansworth (GB)

( * ) Notice: Subject to any disclaimer, the term of this patent is extended or adjusted under 35 U.S.C. 154(b) by 0 days.

(21) Appl. No.: 09/423,773

(22) PCT Filed: May 12, 1998

(86) PCT No.: PCT/GB98/01351

§ 371 Date: Nov. 10, 1999

§ 102(e) Date: Nov. 10, 1999

(87) PCT Pub. No.: WO98/51867

PCT Pub. Date: Nov. 19, 1998

(30) Foreign Application Priority Data

May 12, 1997 (GB) ..... 9709629

(51) Int. Cl.[7] ..... E04B 1/682; E02D 5/18

(52) U.S. Cl. ..... 52/396.02; 52/396.04; 52/127.3; 52/688; 52/719; 405/267

(58) Field of Search ..... 52/260, 396.02, 52/396.03, 396.04, 396.05, 396.06, 127.3, 169.9, 742.13, 688, 719, 586, 372, 687; 404/68, 69, 65, 48, 64; 405/267

(56) References Cited

U.S. PATENT DOCUMENTS

| | | | | |
|---|---|---|---|---|
| 1,193,033 | * | 8/1916 | Llwellyn | 52/396.02 X |
| 3,465,532 | * | 9/1969 | Belden | 52/396.02 X |
| 3,796,054 | * | 3/1974 | Piccagli | 52/396.04 |
| 4,582,453 | * | 4/1986 | Ressi Di Cervia | 405/267 |
| 4,728,226 | * | 3/1988 | Ressi Di Cervia | 405/267 |
| 4,784,516 | * | 11/1988 | Cox | 52/396.06 X |
| 4,901,495 | * | 2/1990 | Gottschling | 52/396.05 |
| 4,990,210 | | 2/1991 | Gläser et al. . | |
| 5,360,293 | * | 11/1994 | Breaux et al. | 405/267 |

FOREIGN PATENT DOCUMENTS

| | | |
|---|---|---|
| 34 30 789 | 3/1986 | (DE) . |
| 35 03 542 | 10/1986 | (DE) . |
| 0 411 682 | 2/1991 | (EP) . |
| 0 580 926 A1 | 2/1994 | (EP) . |
| WO 84/03315 | 8/1984 | (WO) . |

* cited by examiner

*Primary Examiner*—Carl D. Friedman
*Assistant Examiner*—Winnie Yip
(74) *Attorney, Agent, or Firm*—Herbert Dubno

(57) ABSTRACT

A waterbar for use between adjacent panels (22, 24) in a diaphragm wall, the waterbar comprising a first member (5) in the form of an elongate strip (6) provided along a first longitudinal edge (8) with a hydrophilic material (7) and along the opposite longitudinal edge (9) with a retaining channel (10), and a second member (12) in the form of an elongate strip (13) provided along a first longitudinal edge (15) with a hydrophilic material (14) and along the opposite longitudinal edge (16) with a keying projection (17). The retaining channel (10) of the first member (5) is shaped so as to slidably retain the keying projection (17) of the second member (12), and either the retaining channel (10) or the keying projection (17) is provided along its length with a hydrophilic material (18), which serves to seal the joint between the first and second members (5,12). The first member (S) is installed when casting the first (22) of the adjacent panels (22, 24) of the diaphragm wall, whereas the second member (12) is installed when casting the second (24) of the adjacent panels. (22, 24). In this way, prolonged exposure of the hydrophilic material (7,14,18) to water during installation is reduced, and the integrity of the joint is improved.

6 Claims, 3 Drawing Sheets

HYDROPHILIC WATERBAR FOR DIAPHRAGM WALL JOINTS

FIELD OF THE INVENTION

CROSS REFERENCE TO RELATED APPLICATIONS

This application is a national stage of PCT/GB/01351 filed May 12, 1998 and based upon GB 9709629.1 of May 12, 1997 under the International Convention.

FIELD OF THE INVENTION

The present invention relates to an apparatus for sealing joints in diaphragm walls and, more particular to a multi-part waterbar incorporating a hydrophilic material which swells upon contact with water.

BACKGROUND OF THE INVENTION

A diaphragm wall is made by casting a series of concrete panels, which may be reinforced, in excavated trenches as described, for example, in EP 0 101 350 and EP 0 402 247. In some cases, alternate 'primary' panels are constructed first, followed by infill (i.e. closing) 'secondary' panels. The installation sequence would be, for example, panels 1, 3, 5, 7, 9, 11 etc. followed by panels 2, 4, 6, 8, 10 etc. In other cases, only a few 'primary' panels are first constructed, for example panels 1, 10 and 20. Following this, a series of 'continuity panels 2, 11, 3, 12 etc. are installed, with the diaphragm wall being completed by 'closing' panels 9 and 19. All primary panels require the use of shutters at each edge of their respective trenches in order to provide well-defined edges to each panel so as to ensure that the joints between adjacent panels may be made watertight. Continuity panels, in contrast, require only one shutter at the edge of the trench furthest away from the previously cast panel. No shutters are required for closing panels. The shutters are conventionally known as 'stop-ends', and provide the concrete at each vertical edge of the panels with a predetermined shape.

In order to reduce water leakage across the joints between panels, it is possible (with some types of stop-end) to install a waterbar between adjacent panels. A waterbar comprises a strip of suitable material, for example rubber, PVC or steel, which has one longitudinal edge embedded in the edge of one cast panel and the other longitudinal edge embedded in the adjacent panel. Preferably, the waterbar extends over substantially the entire height of the diaphragm wall. Such a waterbar may be installed by employing a stop-end provided with a slot in its face into which the waterbar may be fitted, with about one half of its width remaining exposed. When concrete is poured into the trench on this side of the stop-end and allowed to set, the stop-end may subsequently be removed so as to leave approximately half the waterbar embedded in the resulting concrete panel. When the next panel is cast, the remaining exposed portion of the waterbar will become embedded in concrete, thereby resulting in a seal between the two adjacent panels. Typical waterbars have beaded longitudinal edges, giving the waterbar a dumb-bell shaped cross-section, with an optional central bulb.

This type of waterbar, however, does not necessarily guarantee watertightness at panel joints. This is because the known varieties of waterbar rely on the fact that concrete shrinks slightly upon setting. An element which is completely surrounded by concrete will be gripped all round as the concrete shrinks, but the beaded edges of the known varieties of waterbar are not completely surrounded by concrete due to the presence of the central part of the waterbar. Accordingly, there is a potential risk of water leakage. Furthermore, installation conditions are in practice far from perfect, partly because the waterbar is installed "blind" under a bentonite mud containing suspended sand and the like, and partly because the concrete is cast without vibration, which means that the bentonite and/or sand and the like may not be fully removed from the edges of the waterbar.

Waterbars made of hydrophilic materials have been used at construction joints in conventional "above ground" concrete structures. The hydrophilic material is placed at the joint in dry conditions. If and when water enters the joint, the hydrophilic material will swell, thereby forming a seal between the two adjacent concrete members By contrast, the use of hydrophilic waterbars in diaphragm wall construction presents a number of problems, not least because installation takes place in an aqueous environment, and the part of the waterbar to be incorporated into the second panel will swell before the trench for that panel is excavated and the concrete cast. One way of approaching this problem is to use hydrophilic waterbars provided with a protective, e.g. sugar, coating, which can theoretically give a delay of several days before swelling occurs. This, however, is often unreliable, mainly because the coating resembles a sugar glaze which is cracked when the waterbar is flexed, is easily damages in handling, and has inherent imperfections in the coating, all of which will lead to premature swelling of portions of the waterbar. Moreover, in many installations it is not unusual to leave more time between the casting of adjacent panels than can be accommodated by the protective coating; indeed, intervals of up to thirty days are not uncommon.

SUMMARY OF THE INVENTION

According to the present invention, there is provided a waterbar for use between adjacent panels in a diaphragm wall, the waterbar comprising:

i) a first member in the form of an elongate strip provided along a first longitudinal edge with a hydrophilic material and along the opposite longitudinal edge with a retaining channel; and ii) a second member in the form of an elongate strip provided along a first longitudinal edge with a hydrophilic material and along the opposite longitudinal edge with a keying projection;

wherein the retaining channel of the first member is shaped so as slidably to retain the keying projection of the second member, and wherein either the retaining channel or the keying projection is provided along its length with a hydrophilic material which serves, in use, to seal the joint between the first and second members.

In the building of a diaphragm wall, a first trench is excavated and a stop-end is placed at each end of the trench. Each stop-end may be provided with a longitudinal slot into which the first member of the waterbar is placed, such that the first edge of the member is exposed. It is usual for the first member of the waterbar to be placed in the slot prior to installation of each stop-end. Concrete is then poured into the trench so as to form a panel, the first edge of the waterbar member becoming embedded in the edge of the panel. Bentonite may be pumped through the retaining channel of the first member of the waterbar so as to keep this clear of concrete and other materials. Once the concrete has set and an adjacent trench has been excavated, the stop-end is removed, leaving the retaining channel of the first member exposed. The keying projection of the second member of the waterbar is then slidably fitted into the retaining channel of the fist member before further concrete is poured in order to form a second panel. The two panels are then joined by a two-piece waterbar which is provided with a hydrophilic material at its interfaces with the panels as well in the region of its interlocking joint. These are the only locations where water may flow between the adjacent panels of the diaphragm wall. The presence of a hydrophilic material which swells upon contact with water serves significantly to reduce the possibility of such water flow.

It is to be understood that, alternatively, the second member of the waterbar may be installed first, followed by the first member once the first concrete panel has set.

By providing a two-part waterbar, each part of which need only be installed at the time its associated concrete panel is cast, the present invention overcomes the problems encountered by known hydrophilic waterbars. In particular, because the present invention does not require the hydrophilic components of the waterbar to be exposed to water for excessive periods during installation, the problems associated with inefficient protective coatings are obviated.

The first and second members of the waterbar according to the present invention may be made of any suitable material, such as plastics, rubber or steel etc. A particularly suitable material is high density polyethylene (HDPE) or the like. The hydrophilic material may comprise a mixture of bitumen and dry bentonite or, more preferably, a polymer such as that sold under the trade mark Hydrotite. Hydrotite is a hydrophilic chloroprene-based rubber sealing material.

Alternatively, instead of each stop-end being provided with a longitudinal slot adapted to receive the first member of the waterbar, each stop-end may be provided with attachment means which allows the first member of the waterbar to be releasably joined to one face of the stop-end. This attachment means may take the form of a pair of generally parallel longitudinal bars welded to one face of each stop-end. In this way, when the stop-end is removed from a cast panel, the first member of the waterbar is left embedded in the panel such that the retaining channel is located within the body of the concrete. This may ease the vertical removal of the stop-end from the concrete panel by way of a vibrator or simply by lifting the stop-end.

BRIEF DESCRIPTION OF THE DRAWING

For a better understanding of the present invention, and to show how it may be carried into effect, reference shall now be made by way of example to the accompanying drawing in which.

SPECIFIC DESCRIPTION

Figure 1:
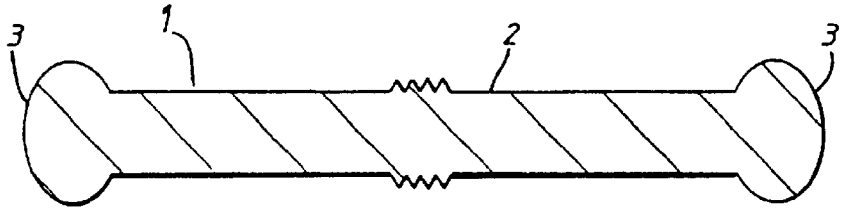
Fig.1 PRIOR ART
FIG. 1 shows in cross-section a prior art dumb-bell-shaped waterbar.
Figure 2:
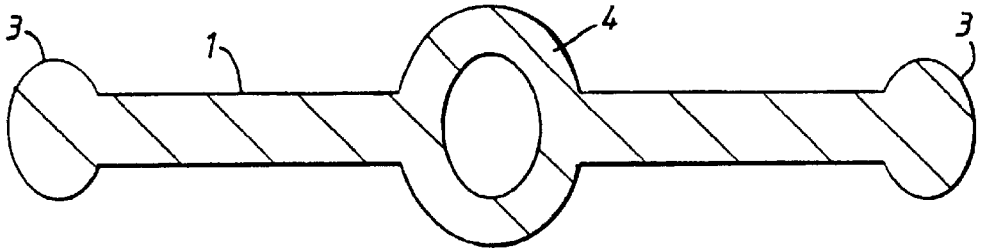
Fig.2 PRIOR ART
FIG. 2 shows in cross-section a prior art center bulb waterbar.

FIG. 1 shows a known type of waterbar 1, comprising a flat central section 2 provided with beaded edges 3 which give a dumb-bell-shaped cross section. FIG. 2 shows another known type of waterbar 1, similar to that shown in FIG. 1 but including a central bulb 4. Both these types of waterbar are one-piece articles, with the consequence that it is difficult to employ a hydrophilic element, since this will be exposed to water for long periods during the installation process, thereby resulting in premature swelling.

Figure 3:
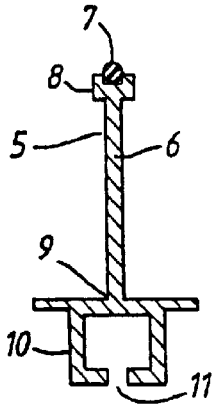
FIG. 3 shows in cross-section a first member of a waterbar according to the present invention.

FIG. 3 shows a first member 5 of a waterbar according to the present invention. The first member 5 comprises a generally flat central section 6 provided with a strip 7 of hydrophilic material along substantially all of one longitudinal edge 8. The other longitudinal edge 9 is provided with a retaining channel 10, which runs substantially along the entire length of the member 5. The retaining channel 10 is provided with a reentrant mouth 11.

Figure 4:
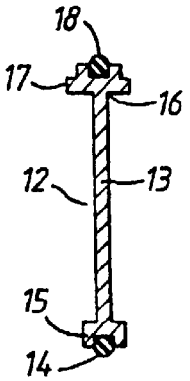
FIG. 4 shows in cross-section a second member of a waterbar according to the present invention.

FIG. 4 shows a second member 12 of a waterbar according to the present invention. The second member 12 also comprises a generally flat central section 13 provided with a strip 14 of hydrophilic material along substantially all of one longitudinal edge 15. The other longitudinal edge 16 is provided with a keying projection 17, which runs substantially along the entire length f the member 12. The keying projection 17 is shown in the form of a flange, although any other suitable configuration may be used. In the illustrated embodiment, a further strip 18 of hydrophilic material is provided along the length of the keying projection 17.

Figure 5:
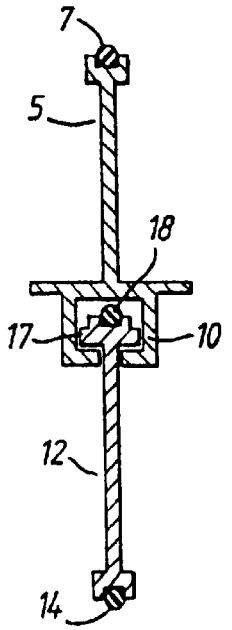
FIG. 5 shows in cross-section the first member of FIG. 3 joined to the second member of FIG. 4.

The first and second members 5, 12 may be interlocked as shown in FIG. 5. The keying projection 17 of the second member 12 is inserted into the retaining channel 10 of the first member 5 by sliding the second member 12 into position once the first number 5 has been installed. It should be noted that, where the second member 12 is installed before the first member 5, the strip 18 of hydrophilic material should be disposed ion the retaining channel 10 of the first member 5. This is because the hydrophilic material would otherwise be exposed to water during the period between the casting of successive concrete panels.

The strips 7, 14, 18 of hydrophilic material may be attached to the member 5, 12 by way of adhesive, or they may simply be push-fitted into retaining grooves.

The first and second members 5, 12 typically have a thickness in the range of 2 to 10 mm, preferably 2 to 6 mm, and a width in the range of 50 to 150 mm, preferably 70 to 120 mm. The length of the first and second member 5, 12 is selected so as to correspond to the depth of the diaphragm wall being built.

Figure 6:
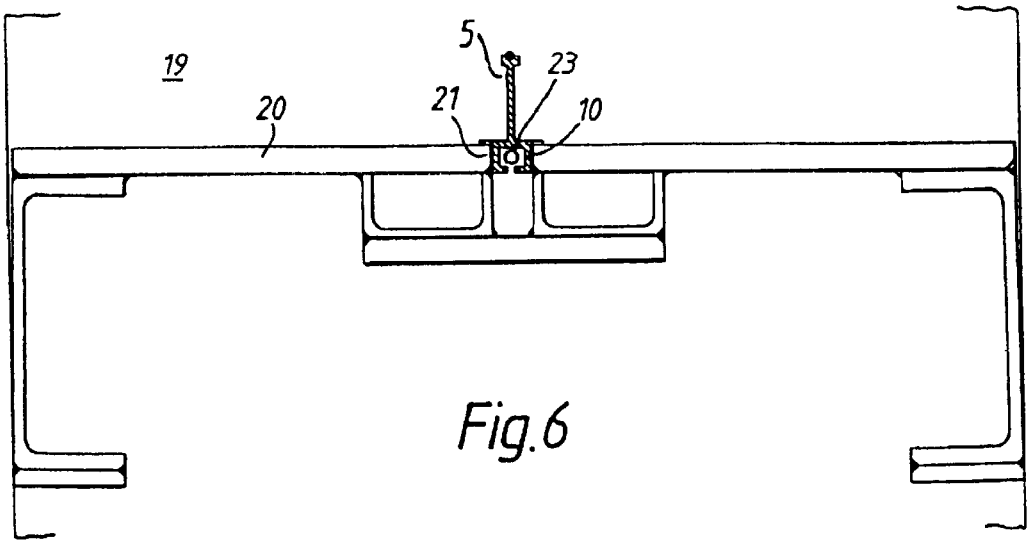
FIGS. 6 to 8 show in cross section the steps involved when installing a waterbar according to the present invention.
Figure 7:
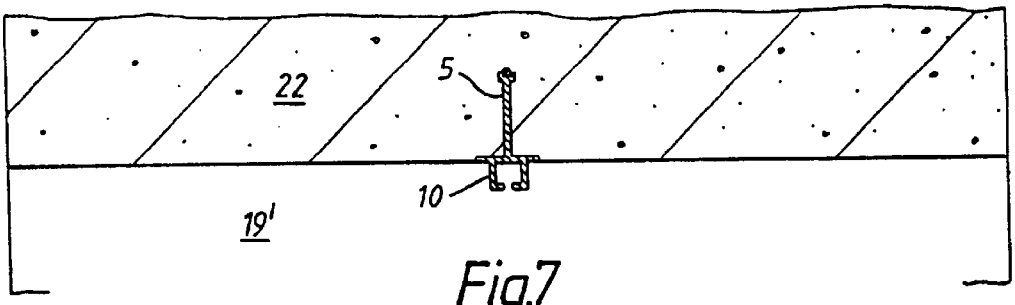
Figure 8:
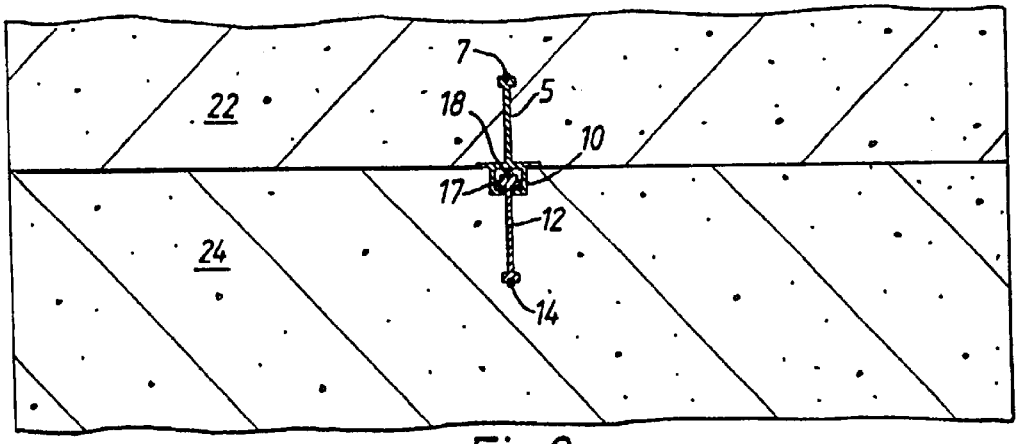

The steps involved in the installation of a waterbar according to the present invention are outlined in FIGS. 6, 7 and 8. Firstly, after excavation of a trench section 19, a stop-end 20 is placed in position. The stop-end 20 includes a longitudinal slot 21 which is adapted to receive the retaining channel 10 of the first member 5 of the waterbar. Once the stop-end 20 and the first member 5 are in position, a plastics pipe 23, typically made out of semi-rigid PVC, may advantageously be place into the retaining channel 10, ideally to the full length of the first member 5. Concrete is then poured into the trench 19 on the appropriate side of the stop-end 20 so as to form a first panel 22 as shown in FIG. 7. While the concrete is being poured and allowed to set, a flushing fluid, e.g. a bentonite suspension, is pumped through the pipe 23 so as to keep the retaining channel 10 free of group and other debris. An adjacent trench section 19' is then excavated on the free side of the stop-end 20, and the stop-end 20 (and the pipe 23 if fitted) is removed so as to leave the retaining channel 10 of the first member 5 exposed. The keying projection 17 of the second member 12 is then slid along the full length of the retaining channel 10 of the first member 5 so as to complete the waterbar, and concrete is poured into the trench section 19' in the usual manner so as to form a second panel 24 in which the second member 12 is embedded, as shown in FIG. 8.

In the final, installed state, the waterbar presents three hydrophilic strips 7, 14, 18, one at each extremity of the waterbar and one at the interlock. These are the only locations where water can flow across the diaphragm wall joint, and the hydrophilic strips 7, 14, 18 ensure that the presence of water will improve the integrity of the joint.

Figure 9:
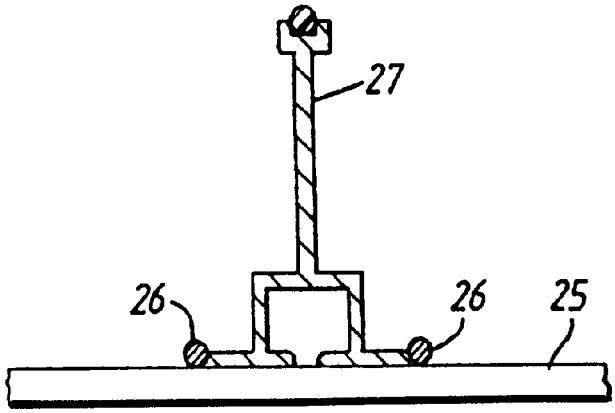
FIG. 9 shows in cross section a first member of a waterbar according to the present invention releasably attached to one face of a stop-end.
Figure 10:
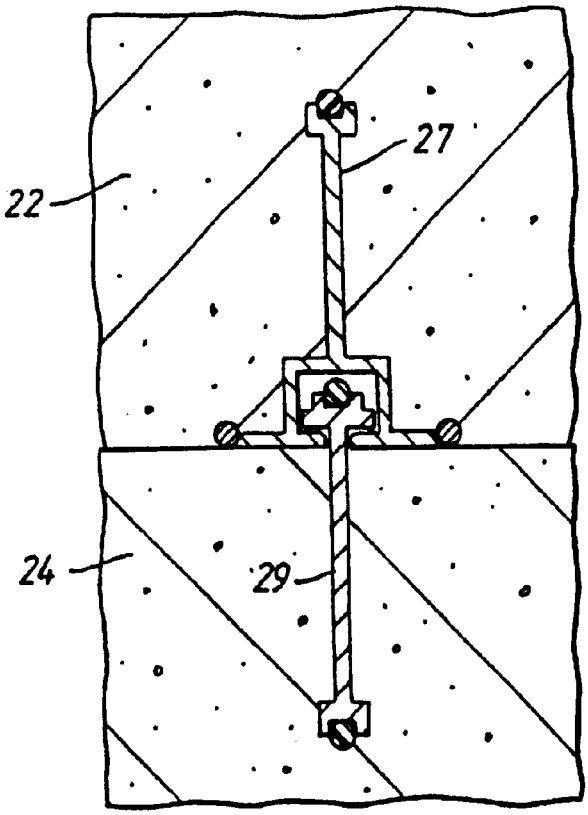
FIG. 10 shows in cross-section a completed waterbar incorporating the first member shown in FIG. 9.

Instead of using stop-ends 20 each provided with a longitudinal slot 21, as shown in FIG. 6, it is possible to employ a stop-end 25 having retaining means 26 on one face thereof, as shown in FIG. 9. The retaining means 26 may comprise a pair of longitudinally-extending, generally parallel bars, which are lightly welded or otherwise affixed to the face of the stop-end 25. A modified first waterbar member 27 is then attached to the face of the stop-end 25 by way of the retaining means 26, and the composite structure lowered into position. A concrete panel is then cast in the usual manner and allowed at least partially to set. When the stop-end 25 is removed, the firs waterbar member 27 is embedded in the concrete panel in such a way that the mouth of the retaining channel 28 is flush with the face of the panel. The bars 26 also become embedded in the concrete panel and are separated from the face of the stop-end 25 as this is removed. A second waterbar member 29 is then attached to the first waterbar member 27 before an adjoining concrete panel is cast, as shown best in FIG. 10.

What is claimed is:

1. A waterbar for use between adjacent panels in a diaphragm wall, the waterbar comprising:

i) a first member in the form of an elongate strip provided along a first longitudinal edge with a hydrophilic material and along the opposite longitudinal edge with a retaining channel; and ii) a second member in the form of an elongate strip provided along a first longitudinal edge with a hydrophilic material and along the opposite longitudinal edge with a keying projection;

wherein the retaining channel of the first member is shaped so as slidably to retain the keying projection of the second member, and wherein either the retaining channel or the keying projection is provided along its length with a hydrophilic material which serves, in use, to seal the joint between the first and second members.

2. A waterbar as claimed in claim 1 wherein the retaining channel has a reentrant mouth portion.

3. A waterbar as claimed in claim 1, wherein the keying projection comprises a flange.

4. A waterbar as claimed in claim 1 wherein the first and second members are made from high density polythene.

5. A waterbar as claimed in claim 1 wherein the hydrophilic material comprises a polymer.

6. A waterbar as claimed in claim 1 wherein the hydrophilic material comprises a chloroprene based rubber sealing material.

* * * * *